US006968577B1

(12) United States Patent
Taft, Jr.

(10) Patent No.: US 6,968,577 B1
(45) Date of Patent: Nov. 29, 2005

(54) SPILL RESISTANT PORTABLE URINAL

(76) Inventor: Charles Taft, Jr., 229 Branford Rd. Unit 107, North Branford, CT (US) 06471

( * ) Notice: Subject to any disclaimer, the term of this patent is extended or adjusted under 35 U.S.C. 154(b) by 0 days.

(21) Appl. No.: 11/101,319

(22) Filed: Apr. 7, 2005

(51) Int. Cl.[7] ..... A47K 11/00
(52) U.S. Cl. ..... 4/144.1; 4/144.3; 604/350
(58) Field of Search ..... 4/144.1–144.4, 4/450, 455; 604/323, 326, 329, 335, 349, 604/350; 137/515, 846

(56) References Cited

U.S. PATENT DOCUMENTS

| | | | |
|---|---|---|---|
| 4,270,231 | A | 6/1981 | Zint |
| 5,797,147 | A | 8/1998 | Young et al. |
| D399,308 | S | 10/1998 | Garlock |
| 6,021,529 | A | 2/2000 | Abbato |
| 6,119,280 | A | 9/2000 | Rentsch |
| 6,588,024 | B2 | 7/2003 | Koeliker et al. |

*Primary Examiner*—Tuan Nguyen
(74) *Attorney, Agent, or Firm*—Lawrence J. Gibney, Jr.

(57) ABSTRACT

This is a portable male urinal, which has a separate valve mechanism to prevent the urine from spilling from the device, but also allowing the device to be filled at the appropriate times by moving a handle in a certain direction. It improves the prior art be enabling the user to lock the valve in the "open" position.

2 Claims, 2 Drawing Sheets

SPILL RESISTANT PORTABLE URINAL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to male urinals, which are portable and also spill resistant. At times it may become necessary to have a portable urinal when the individual needs to void but cannot ambulate such as in a hospital setting.

B. Prior Art

A representative example of relevant prior art is Abbato, U.S. Pat. No. 6,021,529. This is a portable male urinal, which has a handle, and a structure similar to the one as the present application as well as a flap or valve assembly connected with a hinge pin. However, it does not have a separate means to operate the handle for the valve from the outside.

Another example of the prior art is Koelliker, U.S. Pat. No. 6,588,024. This has a separate baffle assembly but does not have any way to operate the valve from the exterior.

A third example of the prior art is Young, U.S. Pat. No. 5,797,147, which is a portable urinal with a measuring gauge on the side. Again, this urinal, like the others previously cited do not have a separate mechanism to operate the valve from the outside.

BRIEF SUMMARY OF THE INVENTION

This is a portable male urinal in which urine is stored within a container. It has a handle for easy carrying. On the outside of the container is a handle to operate a valve or flap within the interior of the device to allow the urine into the container but prevent the urine from exiting the container. On the outside of the container is a measuring device on the side to measure the quantity of urine in the container.

A separate handle for the valve or flap is hinged and is operated by the user. This flap handle allows passage of the urine past the valve and into the container but not out of the container. A clip to lock the handle in place is also provided.

It is an object of this device to improve upon existing prior art related to portable male urinals. Specifically, this device incorporates a handle, which operates a valve or flap from the outside the device. This separate handle will open and close the valve or flap to allow urine to enter the container when necessary, but also prevent urine from exiting the container when needed. A means to empty the contents of the container is also provided.

DETAILED DESCRIPTION OF THE EMBODIMENT

Figure 1:
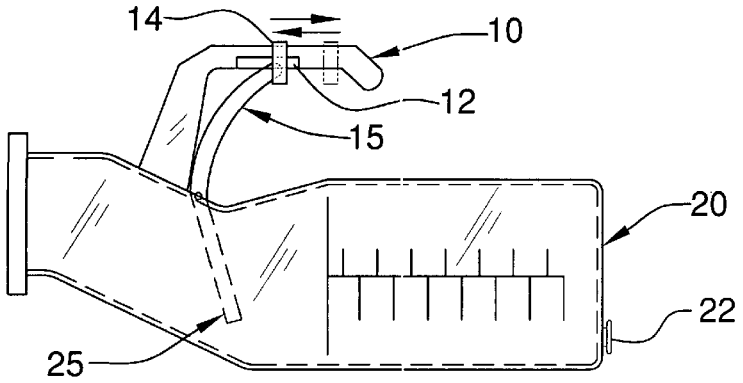
FIG. 1 is a side view of the device.
Figure 2:
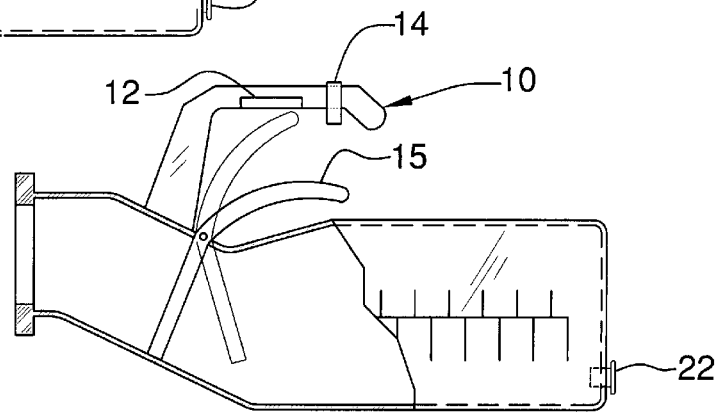
FIG. 2 is a side view of the device with a portion cut out to expose the valve, handle and hinge mechanism.
Figure 3:
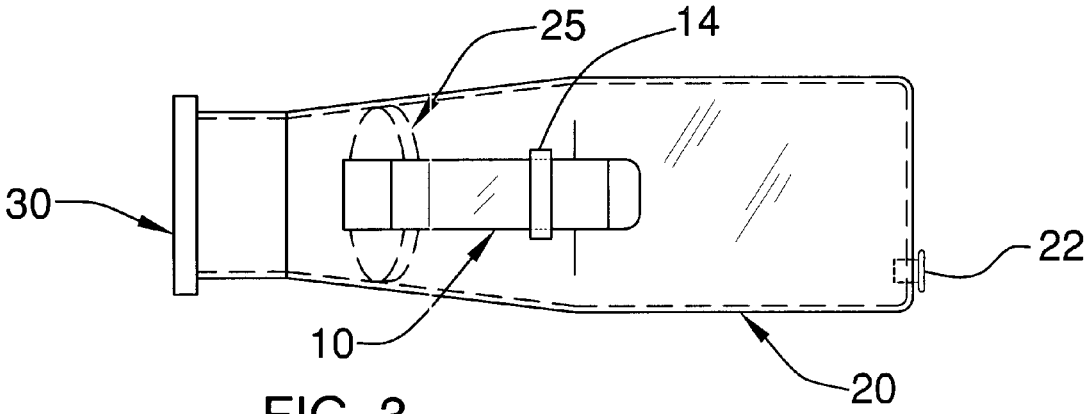
FIG. 3 is a top view of the device.
Figure 4:
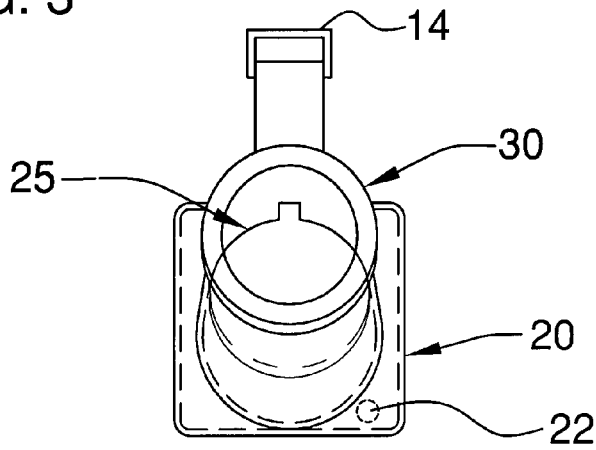
FIG. 4 is a front view of the device.

This device is a portable male urinal. It is constructed with a definite shape and has an opening 30 in the front as well as a storage container 20. FIG. 3 The opening 30 is comparatively small compared to the storage container 20 but large enough to provide a means of access to deposit the urine in the storage container 20. FIG. 1,4.

On the top surface is a carrying handle 10. The carrying handle 10 is stationary and extends upward from the container 20. The carrying handle 10 operates independently from the flap handle 15, which controls the operation of the valve 25.

A handle grip 14 is located on the handle 10 to lock the valve in the "open" position. A groove or channel 12 on the underside of the carrying handle 10 is provided to enable the handle grip 14 to lock the flap handle 15 in position. The handle grip 14 is placed over the carrying handle 10 and is allowed to slide over a portion of the flap handle 15 when that is necessary.

The flap handle 15, operates a valve 25 which is in the interior of the device. The valve 25, which is a solid piece, while in the "open" position, allows the urine to pass from the inlet 30 to the interior of the container 20. FIG. 1,2 The valve 25 is operated by pushing the flap handle 15 in a certain direction and allowing the urine to pass into the storage container 20. The flap handle 15 can be locked into an "open" position by the handle grip 14 for the convenience of the user. The flap handle 15 is connected to the storage container using a hinge and a spring (not depicted). The spring is necessary to insure that the valve remains in a "closed" position when not in use. The flap handle 15 can be locked in an "open" position through the means of the handle grip 14. FIG. 1.

Due to cost considerations, this device will probably be made from plastic material. A drain plug 22 is placed on he device to enable the user to empty the storage container. FIG. 1,2,3,4 A means to measure the urine on the side of the storage container 20 is also provided.

What is claimed is:

1. A portable male urinal, which is comprised of:

a. a storage container;

b. a carrying handle;

c. a flap handle;

d. a handle grip;

e. a valve;

f. a opening;

g. a measuring means;

h. a drain plug;

wherein the opening is provided to allow urine to enter the storage container;

wherein the carrying handle for the device is fixed in one position;

wherein a channel of predetermined depth is provided on the underside of the carrying handle;

wherein the handle grip is placed over the carrying handle and fits over the flap handle when necessary to lock the valve open;

wherein the flap handle operates independently from the carrying handle for the device;

wherein the flap handle rotates around a means of connection and operates the valve;

wherein the valve is solid;

wherein the measuring means to measure the fluid in the container is provided;

wherein the drain plug is provided to empty the contents of the storage container is provided.

2. The means of connection for the flap handle as described in claim 1 is further comprised of a hinge and a spring.

* * * * *